United States Patent [19]

Rousselet

[11] 4,098,004

[45] Jul. 4, 1978

[54] APPARATUS FOR THE DEHYDRATION (DRYING) OF TEXTILE MATERIALS

[76] Inventor: Joseph Rousselet, "Montalivet", Annonay (Ardeche), France

[21] Appl. No.: 726,485

[22] Filed: Sep. 24, 1976

[30] Foreign Application Priority Data

Oct. 3, 1975 [FR] France ..... 75 30879

[51] Int. Cl.[2] ..... F26B 17/10

[52] U.S. Cl. ..... 34/57 E; 34/58; 34/82

[58] Field of Search ..... 34/58, 59, 82, 79, 57 R, 34/57 E; 55/315, 385 R, 337; 302/29, 30

[56] References Cited

U.S. PATENT DOCUMENTS

| | | | |
|---|---|---|---|
| 2,750,182 | 6/1956 | Petersen | 55/315 |
| 2,880,519 | 4/1959 | Pollock | 34/58 |
| 3,724,091 | 4/1973 | Rousselet | 34/58 |
| 3,763,572 | 10/1973 | Titus | 34/58 |
| 3,802,089 | 4/1974 | Stephanoff | 34/58 |
| 3,816,982 | 6/1974 | Regnault | 55/337 |
| 3,898,068 | 8/1975 | McNeil | 55/337 |
| 3,991,480 | 11/1976 | Menge | 34/79 |

*Primary Examiner*—John J. Camby
*Assistant Examiner*—Larry I. Schwartz
*Attorney, Agent, or Firm*—Karl F. Ross

[57] ABSTRACT

An apparatus for the dehydration (drying) of textile materials, especially mats or webs of nonwoven fiber or the fiber itself, comprises means for feeding the material to a continuous extractor at the end of which is provided a conduit for the pneumatic transport of the dry material. According to the invention, the conduit opens into a cyclone in which the textile material is permitted to fall by gravity and separate from the entraining air. Means is provided to maintain a pressure equilibrium within the cyclone. The latter means can include a fan or ventilator.

5 Claims, 3 Drawing Figures

APPARATUS FOR THE DEHYDRATION (DRYING) OF TEXTILE MATERIALS

FIELD OF THE INVENTION

The present invention relates to an apparatus for the dehydration (drying) of textile materials and especially textile materials in the form of mats or wads of nonwoven fibers or the fibers themselves. More particularly the invention relates to an apparatus for the extraction of moisture from textile fibers.

BACKGROUND OF THE INVENTION

After textile fibers, filaments and the like are treated in a loose state or as wads or in a mat or web of nonwoven fibers by a treating liquid, it is generally desirable to remove the treating liquid, i.e. to extract the liquid from the fibers for the drying thereof. Generally the textile material contains several times its weight of the treatment liquid and hence the means necessary to dehydrate the textile material, i.e. remove the water or other liquid therefrom, may be somewhat complex.

For example, because of the large volume and weight of treating liquid entrained with the textile material from the treatment vessel, it is not possible to simply subject the textile material to an elevated temperature for a prolonged period because the treatment period becomes prohibitive and the transport path over which the material must be subjected to the drying process becomes inordinately long to accommodate such techniques in conventional textile mills and the like. In fact, the mere use of long transport paths for conveying textile materials through a heated zone has been found to be impractical and even impossible in the case of wads or free textile fibers.

The dehydration or drying of such textile materials can, however, be carried out by continuous centrifugal extraction, e.g. using an extractor of the type described in French Pat. No. 2,087,221 issued May 12, 1970.

This extractor comprises a charging hopper or feeder from which the textile material is introduced into the centrifugal extractor, a distribution cone onto which the material is deposited, a perforated basket receiving the material from the distribution cone, and a pushing plate received at the bottom of the basket and adapted to be displaced axially for driving the extracted material toward the free edge of the basket, the entire assembly being received in the center of a fixed tub, vat or housing.

According to an important feature of this type of centrifugal extractor, the housing has an orifice located at the level of the free edge of the basket and from which the extracted material can be expelled tangentially. The free edge of the basket is provided with vanes or blades adapted to project the extracted material in a tangential manner mentioned above and simultaneously to create a displacement of air to form a transport medium whereby the textile material is conveyed to a conduit by pneumatic emtrainment.

Generally the conduit through which the textile material is pneumatically entrained empties into the workroom or into a chamber of large dimensions in which the transport fluid (usually air) and the extracted material can be separated.

This chamber of large dimension is at the elevated pressure induced by the pneumatic transport system. This elevated pressure makes it difficult to recover the textile materials from the chamber. Furthermore, because of the size of the chamber which has hitherto been deemed necessary, it is difficult to carry out the total cleaning of the chamber which is customarily necessary when one material is to be changed over for another having different characteristics. In practice such cleaning has been found to require an extraordinarily long operation and is difficult to achieve from the point of view of completeness.

OBJECT OF THE INVENTION

It is the principal object of the present invention to provide an improved apparatus for the dehydration of textile materials wherein the aforementioned disadvantages are avoided.

Another object of the invention is to provide an improved system for the extraction of moisture from textile materials which facilitates the recovery of the extracted product and the separation thereof from a pneumatic entrainment fluid.

SUMMARY OF THE INVENTION

These objects are attained in accordance with the present invention in a system of the character described, having a centrifugal extractor and provided, at the outlet end of the aforementioned pneumatic transport conduit, with a cyclone effecting separation of the textile material from the air used to transport it.

Advantageously, the cyclone is provided with means for pressure equilibration, i.e. balancing the elevated pressure generated by the pneumatic transport system, permitting the textile material to fall to the bottom of the cyclone under the effect of gravity and to be removed without difficulty.

According to this aspect of the invention, the air serving for transport and entrainment of the extracted material does not agitate the textile material at the bottom of the cyclone or interfere with its recovery therefrom.

Preferably the equilibrating means for preventing pressure buildup in the interior of the cyclone is constituted by a perforated jacket enclosing a space into which the pneumatic-transport conduit discharges the extracted material and the transport air. The mixture of transport air and textile material thus arrives under pressure into the space surrounded by the perforated jacket which can be constituted as a perforated wall parallel to but spaced apart from the downwardly converging frustoconical wall of the cyclone. Outwardly of this perforated wall, there is provided an annular space which is maintained under suction by an aspirating means.

The extracted material and the transport fluid thus enter the cyclone tangentially at the top of the latter, the solid material descending in a spiral along along the perforated wall. Because of the suction applied to the annular chamber surrounding this perforated wall, the transport fluid passes through the latter without agitating the fibers and is conducted away.

Advantageously, the aspiration duct can be connected to the intake side of the fan, blower or ventilator and is provided, between this suction means and the annular chamber with a valve means or register permitting control of the suction applied to the annular chamber of the cyclone in accordance with the oncoming pressure of the fluid entraining the textile material. Best results are obtained, of course, when the suction is equal to the incoming pressure. In other words, if the incoming airstream has a pressure at the top of the cyclone of, say, 900 mm Hg (140 mm Hg above atmospheric), the suction which is applied is of the value of 140 mm Hg.

BRIEF DESCRIPTION OF THE DRAWING

The above and other objects, features and advantages of the present invention will become readily apparent from the following description, reference being made to the accompanying drawing in which.

SPECIFIC DESCRIPTION

Figure 1:
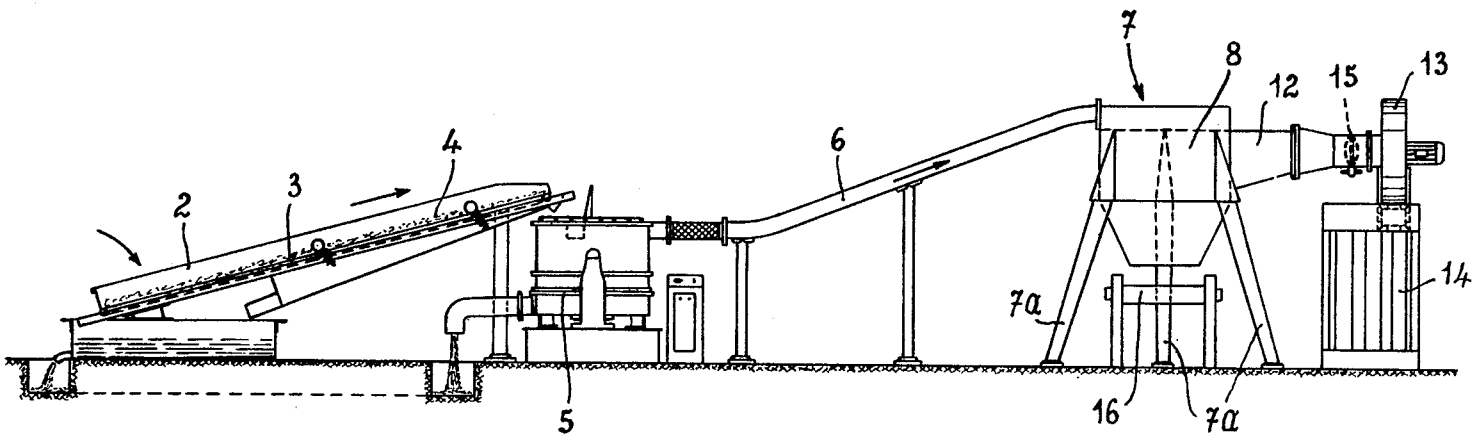
FIG. 1 is a schematic elevational view of an apparatus embodying the invention.
Figure 3:
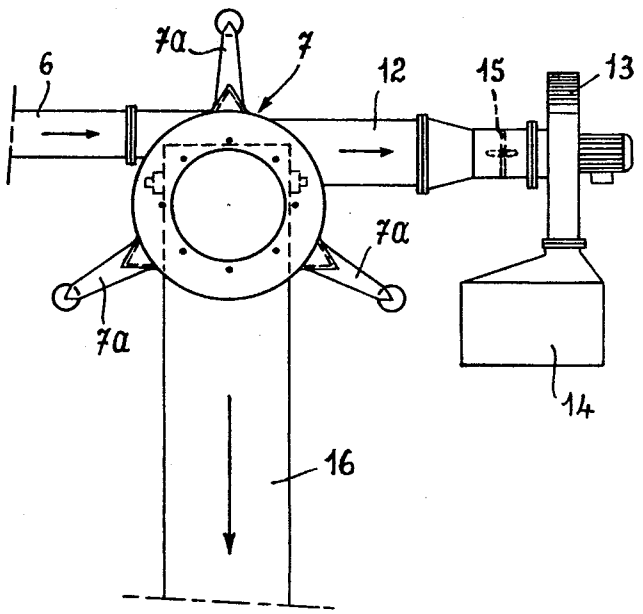
FIG. 3 is a plan view of a part of the apparatus containing the cyclone.

As shown in FIG. 1, the apparatus for the dehydration of the textile material according to the invention comprises a conveyor 2 having a perforated belt 3 on which the textile material 4 undergoes a partial drainage. Rollers can be provided above the belt to squeeze the water partially therefrom.

The conveyor 2 feeds the textile material 4 to the belt of a centrifugal extractor 5 of the continuous type, preferably of the type described in French Pat. No. 2,087,221 of May 12 1970.

This centrifugal extractor has a tangential outlet orifice and is provided with blades as described to propel a pneumatic entraining fluid and the extracted material through a discharge conduit 6 at an elevated pressure. At its other end, the discharge conduit 6 opens tangentially into the tub of a cyclone 7 which is mounted upon legs 7*a*.

Figure 2:
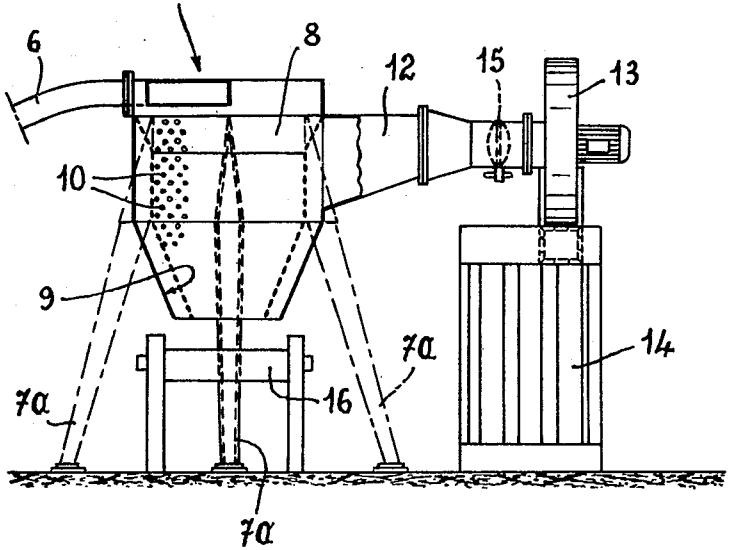
FIG. 2 is a vertical longitudinal section, partly in diagrammatic form, through the cyclone of the present invention.

In the interior of the cyclone (see FIG. 2) a perforated wall 8 is provided to define an inner chamber into which the conduit 6 opens tangentially, and an outer annular chamber which is connected to the inner chamber by the perforations 10 in the wall 8. The wall 8 thus forms a perforated jacket for the cyclone separating chamber. The annular chamber 9 opens into a duct 12 over a substantial portion of the length of the cyclone, e.g. about half of the height thereof, the duct 12 terminating in a fan 13 of the axial intake tangential outflow type. The fan 13 thus generates a suction in the annular chamber 9. Between the annular chamber 9 and the intake side of the fan 13, the duct 12 can be provided with a register, regulating valve or damper as shown at 15 of the butterfly type which enables the suction within the annular chamber 9 to be controlled.

The bottom of the cyclone 7 can be simply opened downwardly onto a conveyor 16 of conventional construction designed to carry away the extracted textile material. The outlet side or discharge of the fan 13 can be connected to a dust collector 14 of the electrostatic precipitator or bag filter type.

It will be apparent that the suction generated in the annular chamber 9 has the effect of balancing the applied pressure of the transport fluid delivered via conduit 6 so that, as the textile material falls in the chamber, it eventually enters the conical bottom portion in which the superatmospheric pressure delivered by the duct 6 is completely balanced or annihilated. Thus the material is able to fall freely by gravity onto the conveyor 16.

The damper 15 permits the suction pressure to match the applied pressure of duct 6. Adjustment of the suction pressure is desirable because the pneumatic transport pressure is generally varied as a function of the material conveyed.

The invention, of course, is not limited to the specific embodiment described and illustrated, but may be modified in various ways within the spirit and scope of the appended claims. More particularly, it may make use of another type of centrifugal accelerator and the perforated wall of the cyclone need not be perforated over its entire height but may be perforated only over its upper zone. Such modifications do not affect either the principle or the operations of the system according to the present invention.

I claim:

1. An apparatus for the dehydration of textile material which comprises:

conveyor means for advancing wet textile material;

a continuously operable centrifugal extractor adjacent said conveyor means and receiving wet textile material therefrom, said centrifugal extractor expelling extracted textile material in a heated transport gas at an elevated pressure;

a conduit receiving the transport gas and extracted material from said centrifugal extractor;

a cyclone connected to said conduit and separating said extracted material from said transport gas;

means for equilibrating the pressure in said cyclone to enable said extracted material to fall to the bottom thereof by gravity, the means for equilibrating the pressure in said cyclone comprising a perforated wall disposed in said cyclone and defining therein a central chamber receiving the wet material and transport gas from said conduit, and an outer annular compartment surrounding said central compartment, said conduit opening tangentially into said central compartment, said means for equilibrating also including a suction-generating device communicating with said annular compartment; and means below said cyclone for removing said material in a dry state therefrom.

2. The apparatus defined in claim 1 wherein said suction-generating device is a fan having an intake and a duct connecting said intake to said annular compartment.

3. The apparatus defined in claim 2, further comprising control means in said duct for regulating the suction generated in said annular compartment.

4. The apparatus defined in claim 2 wherein said fan has a discharge side, said apparatus further comprising a dust-collecting device connected to said discharge side of said fan.

5. The apparatus defined in claim 4 wherein said duct communicates with said annular compartment over at least half the height of said cyclone.

* * * * *